US008528846B2

(12) United States Patent
Kempf et al.

(10) Patent No.: US 8,528,846 B2
(45) Date of Patent: Sep. 10, 2013

(54) VIBRATORY CRUSHING APPARATUS

(75) Inventors: Richard P. Kempf, Crystal Lake, IL (US); Tobin L. Imes, Crystak Lake, IL (US); Steve C. Wiechmann, Sleepy Hollow, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 230 days.

(21) Appl. No.: 12/905,392

(22) Filed: Oct. 15, 2010

(65) Prior Publication Data

US 2011/0089278 A1 Apr. 21, 2011

Related U.S. Application Data

(60) Provisional application No. 61/251,950, filed on Oct. 15, 2009.

(51) Int. Cl.

| | |
|---|---|
| ***B02C 19/00*** | (2006.01) |
| ***B02C 21/00*** | (2006.01) |
| ***B02C 18/02*** | (2006.01) |

(52) U.S. Cl.

USPC ..... 241/262; 241/263

(58) Field of Classification Search

USPC ..... 241/262, 263, 266

See application file for complete search history.

(56) References Cited

U.S. PATENT DOCUMENTS

| | | | | |
|---|---|---|---|---|
| 2,323,544 A | | 7/1943 | Kiesskalt et al. | |
| 2,634,060 A | * | 4/1953 | Ginther | 241/201 |
| 3,272,443 A | | 9/1966 | Reiners et al. | |
| 3,645,458 A | * | 2/1972 | Tobe | 241/175 |
| 3,972,278 A | * | 8/1976 | Witte | 99/451 |
| 4,373,674 A | | 2/1983 | Barrera et al. | |
| 4,688,727 A | * | 8/1987 | Sijsling | 241/56 |
| 5,054,606 A | | 10/1991 | Musschoot | |
| 5,713,457 A | | 2/1998 | Musschoot | |
| 6,029,796 A | | 2/2000 | Musschoot | |

FOREIGN PATENT DOCUMENTS

| | | |
|---|---|---|
| DE | 2819294 | 3/1979 |

OTHER PUBLICATIONS

International Search Report and Written Opinion from corresponding International Application No. PCT/US2010/052826, dated Mar. 29, 2011 (6 pp.).

* cited by examiner

*Primary Examiner* — Faye Francis

(74) *Attorney, Agent, or Firm* — Marshall, Gerstein & Borun LLP

(57) ABSTRACT

A vibratory crushing apparatus includes at least one trough having an inlet end, an outlet end, and a wall defining a material-receiving space having a first cross-sectional area. The apparatus also includes at least one crusher disposed in the trough, the at least one crusher having an outer surface that conforms to an inner surface of the wall about a circumference of the crusher, and a second cross-sectional area that is smaller than the first cross-sectional area so as to define a gap between the outer surface of the at least one crusher and the inner surface of the wall. Further, the apparatus includes a vibration generator coupled to the at least one trough to cause material to move between the inlet end and the outlet end and to cause the at least one crusher to move relative to the wall of the trough.

13 Claims, 2 Drawing Sheets

VIBRATORY CRUSHING APPARATUS

The present application claims benefit of U.S. Provisional Application No. 61/251,950, filed on Oct. 15, 2009, the disclosure of which is incorporated herein by reference in its entirety.

BACKGROUND

This patent is directed to a vibratory apparatus, and, in particular, to a vibratory apparatus suitable for crushing materials.

SUMMARY

According to an aspect of the present disclosure, a vibratory crushing apparatus includes at least one trough having an inlet end, an outlet end, and a wall defining a material-receiving space having a first cross-sectional area and at least one crusher disposed in the trough. The at least one crusher has an outer surface that conforms to an inner surface of the wall about a circumference of the crusher, and a second cross-sectional area that is smaller than the first cross-sectional area so as to define a gap between the outer surface of the at least one crusher and the inner surface of the wall. The apparatus also includes a vibration generator coupled to the at least one trough to cause material to move between the inlet end and the outlet end and to cause the at least one crusher to move relative to the wall of the trough.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
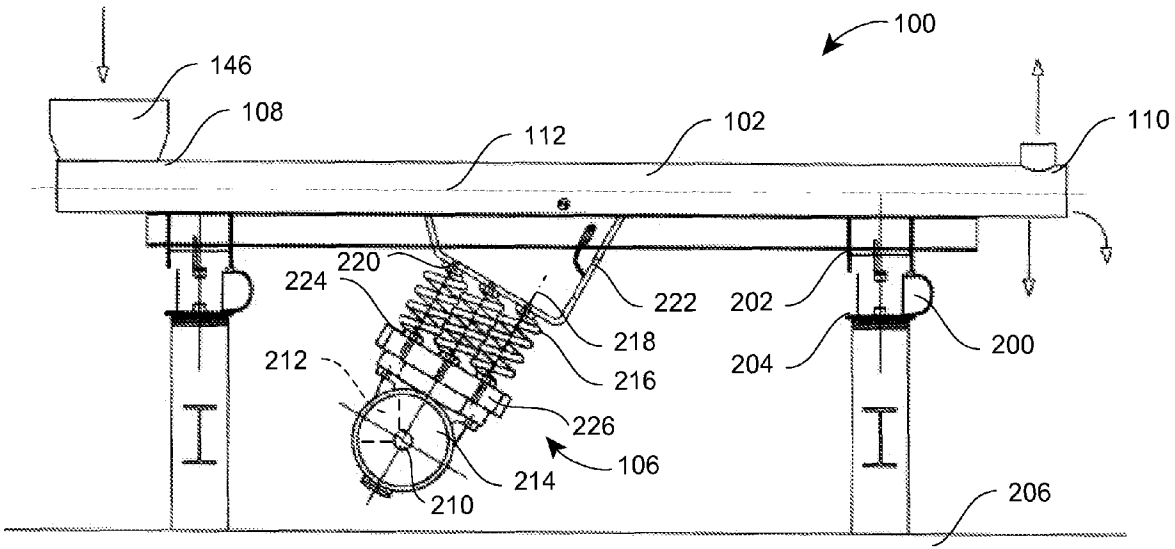
FIG. 1 is a side view of a vibratory crushing apparatus according to the present disclosure.

FIG. 1 illustrates a vibratory crushing apparatus 100. The apparatus 100 may include at least one trough 102, at least one crusher 104 disposed in the trough 102, and a vibration generator 106 coupled to the trough 102.

The trough 102 may have an inlet end 108, an outlet end 110, a longitudinal axis 112 (see FIGS. 1 and 2) that runs from the inlet end 108 to the outlet end 110, and a lateral axis 114 (see FIGS. 3 and 4) that runs orthongally to the longitudinal axis 112. The trough 102 may also include a wall 116 defining a material-receiving space 118 having a first cross-sectional area (see FIG. 3). While the wall 116 is illustrated as closed, i.e., the wall 116 extends about the entire circumference of the trough 102 in cross-section such as is illustrated in FIG. 4, the wall 116 may also be open instead.

Figure 4:
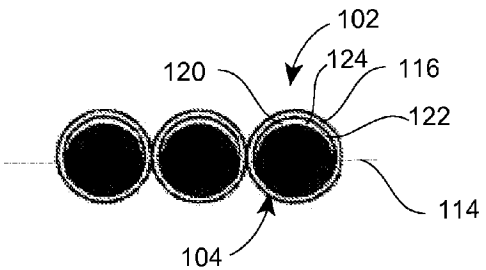
FIG. 4 is an enlarged cross-sectional view of the vibratory crushing apparatus of FIG. 1 taken about line 4-4 in FIG. 2.
Figure 2:
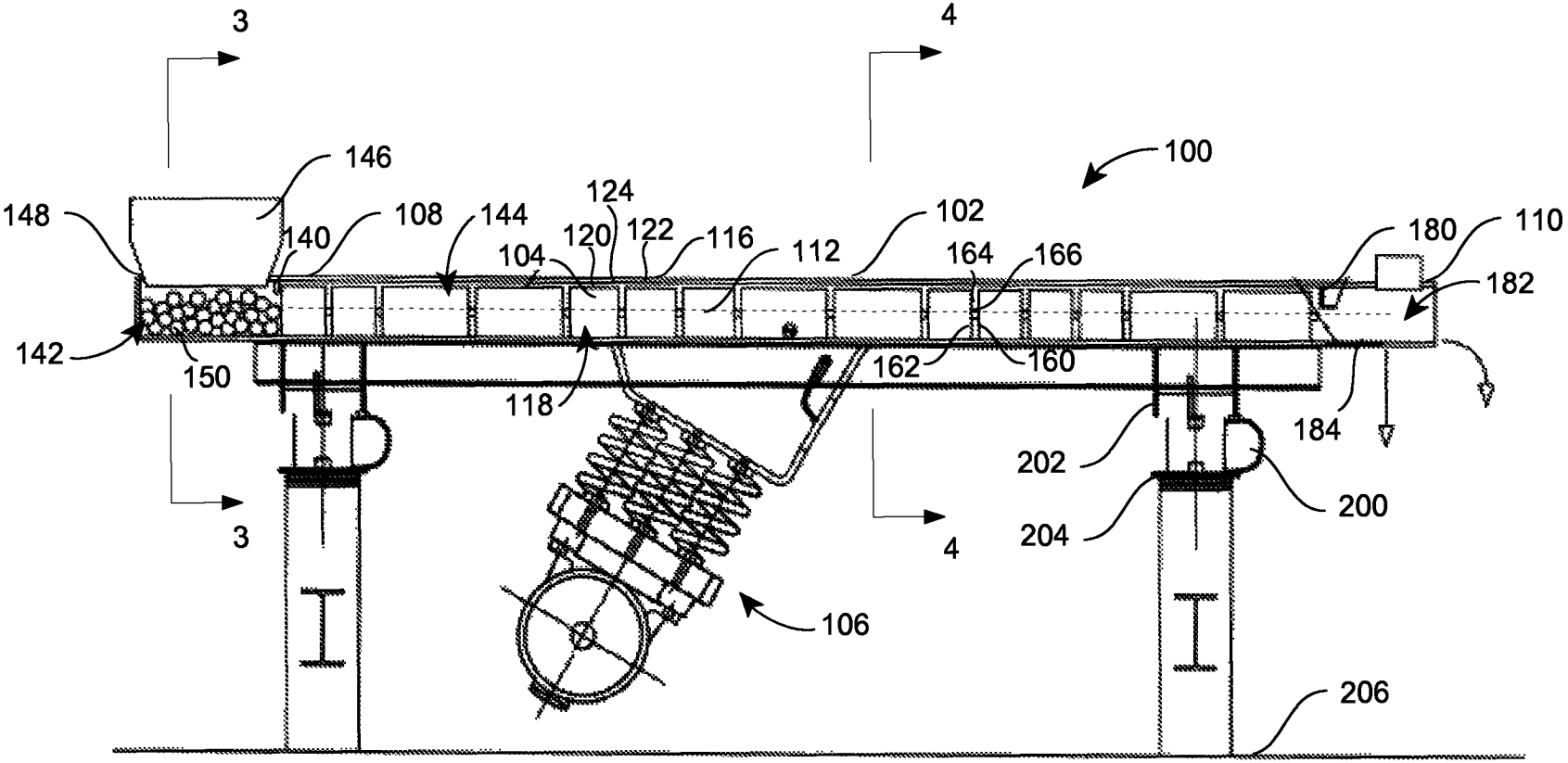
FIG. 2 is a cross-sectional side view of the vibratory crushing apparatus of FIG. 1.

The crusher 104 may have an outer surface 120 that conforms to an inner surface 122 of the wall 116 about a circumference of the crusher 104 (see FIGS. 2 and 4). In this regard, the outer surface 120 conforms to the inner surface 122 such that the shape of the crusher 104 and the wall 116 in cross-section are substantially the same. The crusher 104 also may have a second cross-sectional area that is smaller than the first cross-sectional area to define a gap 124 between the outer surface 120 of the crusher 104 and the inner surface 122 of the wall 116. The material to be crushed moves between the crusher 104 and the wall 116 of the trough 102, and movement of the opposing surfaces 120, 122 of the crusher 104 and the wall 116 relative to each other causes the material passing between these elements to be crushed.

The vibration generator 106 acts on the trough 102 to cause material to move between the inlet end 108 and the outlet end 110 of the trough 102. In particular, the vibration generator 106 causes material disposed in the trough 102 to move along the axis 112 between the inlet end 108 and the outlet end 110. The vibration generator 106 also causes the crusher 104 to move relative to the trough 102.

Having discussed the vibratory crushing apparatus 100 in general terms, the subassemblies and elements of the apparatus 100 are now discussed in detail. In addition, variations and alternatives to the subassemblies and elements of the illustrated apparatus 100 are discussed.

Figure 3:
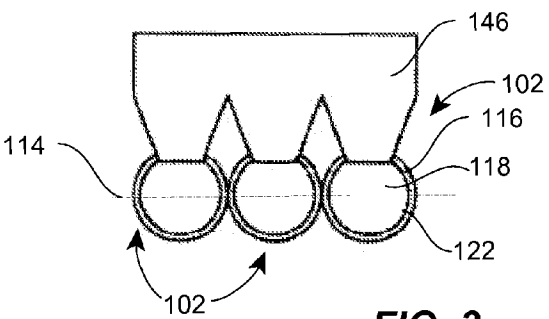
FIG. 3 is an enlarged cross-sectional view of the vibratory crushing apparatus of FIG. 1 taken about line 3-3 in FIG. 2.

Initially, it will be noted, in particular with reference to FIGS. 3 and 4, that the vibratory crushing apparatus 100 according to the present disclosure may include a plurality of troughs 102. In particular, the illustrated embodiment includes three troughs 102 disposed side-by-side with their lateral axes 114 aligned. It will be recognized that instead the vibratory apparatus 100 could include a single trough 102. It will also be recognized that some number of troughs 102 other than three may be included, and their alignment need not be side-by-side with the lateral axes 114 aligned.

As illustrated, each trough 102 of the vibratory crushing apparatus 100 is identical. That is, each trough 102 may have an inlet end 108, an outlet end 110, and a wall 116 defining a material-receiving space 118 having a first cross-sectional area, and a plurality of crushers 104 may be disposed in each trough 102, the plurality of crushers 104 each having an outer surface 120 that conforms to an inner surface 122 of the wall 116 about a circumference of the crusher 104, and a second cross-sectional area that is smaller than the first cross-sectional area so as to define a 124 gap between the outer surface 120 of the crusher 104 and the inner surface 122 of the wall 116. It will be recognized, however, that each of the troughs 102 may vary in structure relative to the other troughs 102.

The troughs 102 may or may not include one or more partitions to divide the trough 102 into two or more subspaces or chambers. As illustrated, the troughs 102 include at least two partitions that divide the material-receiving space into three chambers, but other embodiments may vary as to the number of partitions and chambers defined, as well as the placement of the partitions. Also, while the illustrated embodiment uses well-defined partitions to separate the chambers, it will be recognized that according to other embodiments the partitions may not be so well-defined.

Referring then to FIG. 2, the trough 102 includes a first partition in the form of a divider 140 disposed within the material-receiving space 118. The divider 140 may be spaced from the inlet end 108 to define a preliminary crushing chamber 142 adjacent the inlet end 108 and a main crushing chamber 144 between the divider 140 and the outlet end 110 and downstream of the preliminary crushing chamber 142. The preliminary crushing chamber 142 may be in communication with a hopper 146 that is disposed above the trough 102, the hopper 146 communicating with the preliminary crushing chamber 142 through an opening 148 in the wall 116 of the trough 102.

Media 150 may be disposed in the preliminary crushing chamber 142, while the crushers 104 are disposed in the main crushing chamber 144. The media 150 may have many different shapes, although as illustrated the media 150 may be in form of spheres or balls. The amount, size and shape of the media 150 used may vary according to the type of material being fed into the vibratory crushing apparatus 100.

Comparing FIGS. 2-4, it will be recognized that the wall 116 in the main crushing chamber 144 defines an elongated hollow tube, while each of the crushers 104 disposed in the main crushing chamber 144 is defined by a solid cylindrical block. As illustrated in FIG. 4, the wall 116 has an annular cross-section that defines the first cross-sectional area, and the crushers 104 have a circular cross-section with the second cross-sectional area. According to certain embodiments, if the center of the crusher 104 were to be aligned with the center of the wall 116, the gap 124 may be an order smaller than (i.e., a ratio of approximately 1:10 relative to) an inner diameter of the wall 116 defined by the inner surface 122. According to particular embodiments, the gap 124 may not be more than an inch.

It will also be recognized that the inner surface 122 of the wall 116, or an outer surface for that matter, may have various materials applied thereto, such as materials for sound deadening applied to the outer surface, for example. The surface may be coated with such materials, or the materials may be applied as a physically separate layer or layers to the surface. It will also be recognized that the surface may include these materials within the wall 116. For that matter, the inner surface 122 may be formed with various textures, which may cause the thickness of the wall 116 to vary in different locations along the length of the chamber 144. All of this is within the scope of the present disclosure.

While a generally cylindrical geometry has been used in the illustrated apparatus 100, the disclosure is not so limited. For example, the wall 116 may have a square shape in cross-section, or the shape of some other multi-side polygon in cross-section. Moreover, while the wall 116 as illustrated appears to be formed as a single piece, it will be understood that it may be defined by a plurality of wall segments, both about the circumference of the wall 116, as well as along its axial length (i.e., along the longitudinal axis 112 of the trough 102). Moreover, as mentioned above, the wall 116 need not be closed, but may have one or more sections that are open along the axial length of the trough 102.

It will also be recognized that while the crushers 104 have been illustrated with a uniform outer surface 120 (i.e., without indentations or other surface variations), it is possible for the outer surface 120 to have indentations, grooves, dimples or other surface variations along sections of the outer surface 120 or over the entire outer surface 120. Along similar lines, it may be possible for the outer surfaces 120 of different crushers 104 to have different surface variations. Moreover, the outer surface 120 of the crushers 104 may be defined by one or more layers that are secured to or coated on an inner core, with the layers and the core being made of a common material or of differing materials.

Further, while a solid crusher 104 has been illustrated and discussed, it will also be appreciated that the crusher 104 may be hollow instead. In this regard, the crusher 104 may have walls that give the crusher 104 a solid exterior shape, but the crusher 104 may be hollow at its center. As a further alternative, the crusher 104 may be designed to be hollow at its center, and then the hollow center may be filled, either partially or fully, with material dissimilar to that of the walls defining the exterior shape of the crusher 104.

It will also be recognized in FIG. 2 that the crushers 104 each have a first end 160 disposed in the direction of the inlet end 108 and a second end 162 disposed in the direction of the outlet end 110. The opposing first and second ends 160, 162 of adjacent ones of the plurality of crushers 104 may have a spacing therebetween to define return paths 164. To maintain the spacing and keep the return paths 164 open, each crusher 104 may have a spacer 166 attached to the second end 162 of the crusher 104 to maintain the spacing between adjacent ones of the plurality of crushers 104. It will be recognized, that the spacers 166 may instead be disposed between the crushers 104 without being attached to the crushers 104.

As to the axial length of the crushers 104, that is the distance between the first and second ends 160, 162 of the individual crushers 104 along the longitudinal axis 112 of the trough 102, this may vary. That is, according to certain embodiments, all of the crushers 104 disposed in a particular trough 102 may have the same or substantially the same axial length. According to other embodiments, such as is illustrated in FIG. 2, the individual crushers 104 may have at least two different axial lengths, so that one or more of the crushers 104 of one axial length are separated by one or more of the crushers 104 of the other axial length or lengths.

The trough 102 may also include a second partition in the form of a holdback 180 disposed within the material-receiving space 118. The holdback 180 is spaced from the outlet end 110 to define a screening chamber 182 adjacent the outlet end 110 and downstream of the main crushing chamber 144. The wall 116 of the trough 102 includes a screen section 184 in communication with the screening chamber 182.

As illustrated, the material exiting the main crushing chamber 144 passes over the screen section 184. The larger materials pass completely over the screen section 184 and through the outlet end 110. Smaller materials pass through the screen section 184 before they reach the outlet end 110. In this sense, the vibratory crushing apparatus 100 may not only crush the material, but may also sort or separate the crushed material. A secondary trough (not shown) may be fixedly attached to the trough 102 below the screen section 184 to convey the material passing through the screen section 184, rather than simply permitting the material to be deposited below the trough 102.

While a single preliminary crushing chamber 142, a single main crushing chamber 144, and a single screening chamber 182 have been illustrated, a plurality of any or all of these chambers 142, 144, 182 may be included in a single vibratory crushing apparatus 100 according to the present disclosure. For example, the screening chamber 182 may be followed by a further length of trough, with partitions that divide the further length of trough into a further main crushing chamber and a further screening section. In this fashion, the smaller particles may be removed from the material moving through the apparatus 100 prior to entering the further main crushing chamber. The removal of the smaller particles may enhance the crushing of the larger particles in the further main crushing chamber, with a final screening (and separation) occurring in the further screening section. According to such an embodiment, the further length of trough would be fixedly attached to the trough 102 to be coupled to the vibration generator 106.

Finally, as illustrated in FIGS. 1 and 2, the vibratory crushing apparatus 100 may include a plurality of resilient members 200 having a first end 202 coupled to the trough 102, and a second end 204 supported on a surface 206. These resilient members 200, which may be defined by a spring as illustrated, may be referred to isolation elements or isolators, in that they isolate the surrounding environment from the vibrations of the remainder of the apparatus 100. While the trough 102 is supported above the surface 206 to be approximately level with the horizontal axis, it is also possible to tilt the axis 112 of the trough 102 to use gravity to enhance or retard the motion of the material along the axis 112 through the trough 102.

As seen best in FIG. 1, the vibration generator 106 may include at least one shaft 210 having one or more eccentric weights 212 attached thereto. The shaft 210 may be disposed orthongally to the longitudinal axis 112 of the trough 102. In particular, the shaft 210 may be defined by a shaft of a motor 214.

As illustrated, the vibration generator comprises at least one resilient member 216 coupling at least one shaft 210 (of the motor 214) to the trough 102, the resilient member 216 having a axis 218 disposed at an angle relative to the longitudinal axis 112 of the trough 102. Resilient member 216, which may be defined by a spring as illustrated, may be referred to as an reactor element or reactor, is attached at a first end 220 to a mounting bracket 222 attached to all three troughs 102, and at a second end 224 to a mounting plate 226 on which the motor 214 is mounted.

While a particular vibration generator 106 has been illustrated in the figures, it will be recognized that other generators may be used as well. For example, the illustrated vibration generator 106 is a two-mass system. It will be recognized that brute force and other type of generators may also be used with the apparatus 100 according to the present disclosure.

In operation, material is fed into the hopper 146. The material exits the hopper 146 under a gravity feed into the preliminary crushing chamber 142, where the media 150 acts on the material before the material moves, under the influence of the vibration generator 106, along the longitudinal axis 112 of the trough 102. Upon entering the main crushing chamber 144, the crushers 104 act on the material as it continues to move along the longitudinal axis 112 of the trough 102. Some of the material may find its way to the top of the crushers 104, and then back down to the bottom of the trough 102 through the return paths 164. The material then exits the main crushing chamber 144 into the screening chamber 182, whereupon it passes over the screen section 184. Certain materials may pass over the screen section 184 and out the outlet end 110, while other materials pass through the screen section 184 and out of the trough 102.

It is believed that the present disclosure may have several benefits, one or more of which may be present in a particular embodiment according to the present disclosure.

We claim:

1. A vibratory crushing apparatus comprising:

at least one trough having an inlet end and an outlet end along a longitudinal axis, and a wall defining a material-receiving space having a first cross-sectional area;

at least one crusher disposed in the trough along the longitudinal axis, the at least one crusher having an outer surface that conforms to an inner surface of the wall about a circumference of the crusher, and a second cross-sectional area that is smaller than the first cross-sectional area so as to define a gap between the outer surface of the at least one crusher and the inner surface of the wall; and a vibration generator coupled to the at least one trough to cause material to move between the inlet end and the outlet end and to cause the at least one crusher to move relative to the wall of the trough, the vibration generator comprising at least one shaft having one or more eccentric weights attached thereto, the shaft disposed orthogonally to the longitudinal axis of the trough.

2. The vibratory crushing apparatus of claim 1, wherein the wall has an annular cross section that defines the first cross-sectional area and the at least one crusher has a circular cross-section with the second cross-sectional area.

3. The vibratory crushing apparatus of claim 2, wherein the gap is an order smaller than an inner diameter of the wall defined by the inner surface.

4. The vibratory crushing apparatus of claim 3, wherein the gap is not more than an inch.

5. The vibratory crushing apparatus of claim 1, wherein the wall defines an elongated hollow cylindrical tube, and comprising a plurality of crushers, each of the crushers defined by a solid cylindrical block.

6. The vibratory crushing apparatus of claim 1, comprising a plurality of crushers each having a first end disposed in the direction of the inlet end and a second end disposed in the direction of the outlet end, the opposing first and second ends of adjacent ones of the plurality of crushers having a spacing therebetween to define return paths.

7. The vibratory crushing apparatus of claim 6, wherein each crusher has a spacer attached to the second end of the crusher to maintain the spacing between adjacent ones of the plurality of crushers.

8. The vibratory crushing apparatus of claim 1, comprising a plurality of resilient members having a first end coupled to the trough and a second end supported on a surface.

9. The vibratory crushing apparatus of claim 1, wherein the vibration generator comprises at least one resilient member coupling the at least one shaft to the trough, the resilient member having an axis disposed at an angle relative to the longitudinal axis of the trough.

10. The vibratory crushing apparatus of claim 1, wherein the vibration generator comprises a motor, the at least one shaft being defined by a shaft of the motor.

11. The vibratory crushing apparatus of claim 1, wherein the at least one trough comprises a divider disposed within the material-receiving space, the divider spaced from the inlet end to define a preliminary crushing chamber adjacent the inlet end and a main crushing chamber between the divider and the outlet end and downstream of the main crushing chamber, media disposed in the preliminary crushing chamber and the at least one crusher disposed in the main crushing chamber.

12. The vibratory crushing apparatus of claim 1, wherein the at least one trough comprises a holdback disposed within the material-receiving space, the holdback spaced from the outlet end to define a screening chamber adjacent the outlet end and downstream of the main crushing chamber, the wall of the at least one trough including a screen section in communication with the screening chamber.

13. The vibratory crushing apparatus of claim 1, comprising a plurality of troughs, each trough having an inlet end, an outlet end, and a wall defining a material-receiving space having a first cross-sectional area, and a plurality of crushers disposed in each trough, the plurality of crushers having an outer surface that conforms to an inner surface of the wall about a circumference of the crusher, and a second cross-sectional area that is smaller than the first cross-sectional area so as to define a gap between the outer surface of the at least one crusher and the inner surface of the wall.

* * * * *